US005718972A

United States Patent [19]

Murase et al.

[11] Patent Number: 5,718,972

[45] Date of Patent: Feb. 17, 1998

[54] NONWOVEN FABRIC MADE OF FINE DENIER FILAMENTS AND A PRODUCTION METHOD THEREOF

[75] Inventors: Shigemitsu Murase; Eiichi Kubo; Koichi Nagaoka; Yoshiki Miyahara, all of Kyoto, Japan

[73] Assignee: Unitika, Ltd., Amagasaki, Japan

[21] Appl. No.: 598,038

[22] Filed: Feb. 7, 1996

Related U.S. Application Data

[63] Continuation of Ser. No. 244,211, filed as PCT/JP93/01417 Oct. 4, 1993, abandoned.

[30] Foreign Application Priority Data

Oct. 5, 1992 [JP] Japan ..... 4-292087

[51] Int. Cl.[6] ..... D02G 3/00

[52] U.S. Cl. ..... 428/360; 428/292; 428/224; 428/296; 428/362; 428/374; 428/370; 156/167; 156/308.2

[58] Field of Search ..... 156/167, 181, 156/309.6, 308.2, 306, 307.1; 264/168, 171, 210.8; 428/296, 396, 370, 374, 357, 292, 360, 362

[56] References Cited

U.S. PATENT DOCUMENTS 4,189,338 2/1980 Ejima et al. .
4,269,888 5/1981 Ejima et al. .
4,737,404 4/1988 Jackson .
5,009,951 4/1991 Ohmae et al. .

FOREIGN PATENT DOCUMENTS 60-259664 12/1985 Japan .
3-294557 12/1991 Japan .
3-294558 12/1991 Japan .

*Primary Examiner*—Merrick Dixon
*Attorney, Agent, or Firm*—Jones, Tullar & Cooper, P.C.

[57] ABSTRACT

The present invention provides a nonwoven fabric made of fine denier filaments of superior bulkiness, heat insulation property and tensile strength, and a production method thereof. This nonwoven fabric is made of fine denier filaments produced by first preparing. First a thermoplastic polymer component "A", then another thermoplastic polymer component "B" which is insoluble in the component "A" and of which the melting point is higher than that of the component "A" by 30° to 180° C. Adopting a bicomponent melt spinning method employing the component "A" and the component "B", the bicomponent conjugate filaments, on which surface at least component "A" is exposed, are obtained. By accumulating these bicomponent conjugate filaments, a web is formed. Then heat is applied to the predetermined areas on the web throughout its entire thickness, whereby only the component A is softened or molten, and the bicomponent conjugate filaments are heat bonded to one another, thus a fleece is obtained. The predetermined areas are shaped like dots or lattices and distributed with a certain space between them. After obtaining the fleece, a wrinkling action is applied to the fleece.

4 Claims, 3 Drawing Sheets

NONWOVEN FABRIC MADE OF FINE DENIER FILAMENTS AND A PRODUCTION METHOD THEREOF

This is a continuation of application Ser. No. 08/244,211 filed as PCT/JP93/01417 Oct. 4, 1993, now abandoned.

FIELD OF THE INVENTION

The present invention relates to a nonwoven fabric made of fine denier filaments suitable for padding in clothing, a material for medical or sanitary use, etc., and to a production method thereof. The nonwoven fabric is highly bulky, with high heat insulation and high tensile strength.

BACKGROUND OF THE INVENTION

Nonwoven fabrics have been heretofore popularly employed in such uses as clothing materials, industrial materials, geotextile materials, construction materials, agricultural materials, horticultural materials, living materials, medical materials and sanitary materials. Among all of the nonwoven fabrics, a nonwoven fabric made of continuous filaments has advantages of high tensile strength and high productivity, as compared with nonwoven fabric made of staple fibers. The production of the nonwoven fabric with high thermal insulation, while maintaining the above advantages may specifically require the filament denier to be as fine as possible.

As for the nonwoven fabric made of fine denier filaments, various methods are well known including, for example, a method in which bicomponent conjugate filaments where both component filaments are incompatible to each other are formed by needle punching splitting, another method subjects the bicomponent conjugate filaments to treatment with a solvent thereby swelling and dissolving one component while separating another component therefrom, or a method in which bicomponent conjugate filaments are split by applying water jet needling thereto. These known methods, however, have several problems to be solved.

That is, needle punching tends to be effective only when the weight (per square meter) of the nonwoven fabric is in the range of 400 to 800 g/m$^2$. This is because if the number of filaments per unit area is small, sufficient entanglements are not achieved by needle punching. Accordingly, the obtained nonwoven fabric tends to be high in weight and, moreover, remarkably poor in softness.

The method of swelling and dissolving one component by treatment with a solvent while separating another component therefrom is disclosed in Japanese Patent Publications (examined) No.24699/1969, No.30629/1977, No. 41316/1987, and No.47579/1989. The methods described, however, are very uneconomical in view of the need to dissolve all or any part of one component. Furthermore, other problems arise with respect to the treatment stage aspect, such as a complicated process due to the dissolution, removal, and recovery of the solvent, and with respect to the arrangement aspect of of non-pollution measures, etc.

As for the splitting method, by applying the water jet needling, Japanese Patent Publication (examined) No. 47585/1989 discloses one such method. In this method, sheath-core type bicomponent conjugate filaments are employed, and the water jet needling is applied to these filaments after making them webs, whereby a nonwoven fabric made of filaments which are finer than 0.5 d and three-dimensionally entangled with one another is obtained. The Japanese Laid-Open Patent Publication (unexamined) No. 219653/1981 proposes a nonwoven fabric mainly composed of multi-filaments which are 0.3 to 9.0 denier. The nonwoven fabric is characterized in that the multi-filaments are crossed over in a random direction and entangled with one another. The multi-filament noted above is composed of fine denier filaments which are finer than 0.5 d and substantially continuous.

In the former splitting technique, however, there exists several problems in that, since the nonwoven fabric made of very fine denier filaments exclusively composed of core components is obtained by crushing sheath components of the sheath-core type bicomponent conjugate filaments, the crushed sheath components cannot be utilized to be any filament for forming the nonwoven fabric, and the crushed pieces of the sheath components may result in dust.

There are further critical problems in both the former and latter techniques. That is, in the nonwoven fabric obtained by applying water jet needling, non-split filaments or splitted very fine filaments are unnecessarily three-dimensionally entangled due to impact by the water jet needling and, as a result, the obtained nonwoven fabric is excessively large in a bulk density, and lacks softness and a heat insulating property. In other words, when applying the water jet needling, splitting and entanglement actions are simultaneously given to the filaments. Therefore it is impossible to well balance only the softness and the heat insulating property by, only using water jet needling, and void three-dimensional entanglements. For these reasons, a use of the nonwoven fabric obtained by the method of water jet needling is limited and do not have a wide range of an application.

Therefore, it is desirable to have a nonwoven fabric made of very fine filaments which is superior in its heat insulating property and softness, and produced by a spun bond process which gives the nonwoven fabric high strength, and low dusting caused by splitting among the techniques for producing the nonwoven fabric made of continuous filaments.

SUMMARY OF THE INVENTION

Accordingly, an object of the present invention is to provide a novel nonwoven fabric which has superior bulkiness and superior heat insualtion, by properly employing bicomponent conjugate filaments which are splitable and heat sensitive for bonding, and by applying heat to a web formed of the accumulated bicomponent conjugate filaments, using a heat embossing method, for example, thereby manifesting a heat sensitive adhesion to form many heat bonded areas with a certain distance kept between one another where the bicomponent conjugate filaments are bonded to each other, and by splitting the bicomponent conjugate filament located in a non-heat bonded areas while applying a wrinkling treatment to the filaments without breaking or damaging the bonded areas and without producing any substantial three-dimensional entaglement.

The present invention relates to a nonwoven fabric made of fine denier filaments which is composed of bicomponent conjugate filaments. The bicomponent conjugate filament is bicomposed of a thermoplastic polymer component "A", and a thermoplastic polymer component "B" insoluble in the component "A" and having a melting point higher than that of the component "A" by 30° to 180° C., and in which at least the component "A" is exposed on a surface of the bicomponent conjugate filament. Heat bonded areas are formed by heat bonding the bicomponent conjugate filaments mutually to one another. The heat bonded areas are provided with a certain space between one heat bonded area and another by softening or melting only the component "A"

of the bicomponent conjugate filaments. Non heat bonded areas, without heat bonding the conjugate filaments of the component "A" and "B", are also formed, being manifested by filaments "A", exclusively composed of the component "A", filaments "B", exclusively composed of the component "B", and non-split conjugate filaments coexisting therein. The filaments "A", the filaments "B" and the non-split bicomponent conjugate filaments are mixedly contained in the non heat bonded area without substantial three-dimensional entanglement thereamong.

The present invention also provides a method for producing a nonwoven fabric made of fine denier filaments comprising the steps of: forming a web by accumulating bicomponent conjugate filaments, each of which is bicomposed of a thermoplastic polymer component "A" and a thermoplastic polymer component "B" insoluble in the component "A" and having a melting point higher than that of the component "A" by 30° to 180° C., and in which at least the component "A" is exposed on a surface of the bicomponent conjugate filament; applying a heat to predetermined areas on the web with a certain space in a direction of a thickness of the web, thereby softening or melting only the component "A", and obtaining a fleece in which the heat bonded areas formed by heat bonding the bicomponent conjugate filaments are formed with a certain space; and wrinkling the fleece to split said bicomponent conjugate filament existing in a non-heat bonded areas, thereby manifesting filaments "A" exclusively composed of the component "A" and filaments "B" exclusively composed of said component "B".

The bicomponent conjugate filament employed in the present invention is hereinafter described. The bicomponent conjugate filament is formed by bicomposing a thermoplastic polymer component "A" and a thermoplastic polymer component "B" which is insoluble in the component "A" and has a melting point higher than that of the component "A" by 30° to 180° C. At least the component "A" is exposed on the surface of the bicomponent conjugate filament. A thermoplastic polymer is employed as the component "A" for the purpose of heat bonding the bicomponent conjugate filaments to one another. Therefore, at least one part of the component "A" must be exposed on the surface of the bicomponent conjugate filament. If not, any bicomponent conjugate filament cannot be bicombined with other bicomponent conjugate filament in spite of heat bonding. Further, the component "B" must have a melting point higher than that of the component "A" by 30° to 180° C., preferably by 40° to 160° C., and most preferably by 50° to 140° C. If the difference in the melting point between these two components is less than 30° C., when melting or softening of the component "A", the component "B" becomes also easy to be softened or degraded. And then, a thermal degradation of a filament structure of the bicomponent conjugate filament may be brought about, which eventually results in a reduction of the mechanical strength of the obtained heat bonded areas. On the contrary, if the difference in the melting point between the two component is more than 180° C., it becomes difficult to produce the bicomponent conjugate filament itself by bicomponent melt spinning. In this regard, the melting points of the components "A" and "B" according to the present invention were measured by the following method. That is, each melting point is measured by differential calorimeter (Perkin-Elmer PSC-2C) at a heating rate of 20° C./min. Furthermore, the component "A" must be a polymer insoluble in the polymeric component "B", for the purpose of reducing an affinity between the components "A" and "B" thereby making it easy to separate the component "A" and "B" from each other. In other words, because it is essential to give a splitting function to the bicomponent conjugate filament. In addition, this splitting function is improved all the more when both components "A" and "B" are exposed on the surface of the bicomponent conjugate filaments.

For a specific combination between the component "A" and "B" (component "A"/component "B"), polyamide/polyester, polyolefin/polyester, polyolefin/polyamide or the like can be preferably employed. Polyethyleneterephthalate, polybutylenetelephthalate, copolyesters mainly composed of them or the like can be employed as the polyester. Nylon 6, nylon 46, nylon 66, nylon 610, copolyamides mainly composed of the nylons specified here or the like can be employed as the polyamides. Polypropylene, high density polyethylene, linear low density polyethylene, ethylene-propylene copolymers or the like can be employed as the polyolefin. In addition, lubricants, pigment, delustering agents, thermo-stabilizer, light resistant agents, UV absorber, antistatic agents, conductive agent, heat reserve agents, etc. can be added to the component "A" or component "B" when required.

Any configuration for bicomposing the components "A" and "B" can be employed as long as the mentioned specific requirements are satisfied. More specifically, it is preferable to bicompose the component "A" and "B" in such a manner that the cross-section of the bicomposed conjugate filament may be formed as illustrated in FIG. 1 to FIG. 4. It is necessary for the component "A" at least to be exposed on the surface of the bicomponent conjugate filament, and it is also preferable that both components "A" and "B" are exposed on the surface of the bicomponent conjugate filament.

DETAILED DESCRIPTION OF THE PREFERRED EMBODIMENTS

Figure 2:
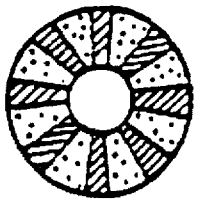
FIG. 2 is a schematic view illustrating another example of a cross-section of the bicomponent conjugate filament employed in the present invention.
Figure 3:
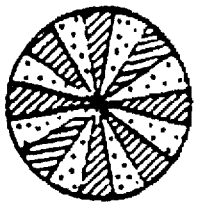
FIG. 3 is a schematic view illustrating a further example of a cross-section of the bicomponent conjugate filament employed in the present invention.

In the drawings, portions indicated by oblique line parts are the component "B", and portions indicated by dotted parts are the component "A". In FIG. 2, the blank center part indicated by neither an oblique line part nor a dotted part can be either hollow (hollow filament) or formed of any polymer component other than the components "A" and "B". The bicomponent conjugate filaments illustrated in the drawings are almost circular and point symmetric in cross-section. It is, however, not always necessary to limit to this configuration, but it is also preferable to be of non-circular and asymmetric in cross-section as a matter of course. A quantitative ratio when bicomposing the component "A" and "B" can be also determined at the discretion of a person skilled in the art, but preferably speaking, component "A"/component "B"=20 to 80/80 to 20 (parts by weight) may be suitable. If the component "A" is less than 20 parts by weight, the bonding strength is reduced among the heat bonded bicomponent conjugate filaments, and it becomes difficult to provide a sufficient tensile strength to the obtained nonwoven fabric. On the contrary, if the component "A" is more than 80 parts by weight, heat bonding among the bicomponent conjugate filaments becomes so excessively strong that large openings are formed in the heat bonded areas due to the aggregation of the bonded conjugate filaments, which eventually results in a reduction of the tensile strength of the obtained nonwoven fabric.

A fineness of the bicomponent conjugate filament employed in the present invention can be also determined at the discretion of a person skilled in the art, but preferably may be in the range of 2 to 12 denier (depending upon a specific gravity of a component polymer). If less than 2 denier, the obtained bicomponent conjugate filaments are excessively fine, and it becomes difficult to produce them by spinning. On the contrary, if more than 12 denier, the bicomponent conjugate filaments are excessively thick, and it becomes difficult to obtain a web of good appearance and at a low weight.

A web is formed by employing the bicomponent conjugate filaments described above and accumulating them. It is preferable that the production of the bicomponent conjugate filaments and the formation of the web are performed in the following manner. First, the thermoplastic polymer component "A" such as the mentioned polyolefin is prepared. Then, the thermo-plastic polymer component "B" insoluble in the component "A" and having a melting point higher than that of the component A by 30° to 180° C. is prepared. The prepared two components "A" and "B" are then introduced in a melt spinning apparatus equipped with a bicomponent spinneret, and thus the bicomponent conjugate filaments are obtained by conventionally known bicomponent melt spinning. At the time of introducing the components "A" and "B" into the bicomponent spinneret, it is required that at least one part of the component "A" is exposed on the surface of the obtained bicomponent conjugate filaments. To perform the melt spinning of the components "A" and "B", it is satisfiable to heat these components at a temperature higher than each melting point by 20° to 60° C. If the difference in the melting point between the components "A" and "B" exceeds 180° C., there is a possibility of heating the component "A" at a temperature far higher than the melting point, due to a thermal influence by the molten component "B", to the extent of decomposing or deteriorating the component "A". If the spinning temperature is lower than the mentioned temperature range, it becomes difficult to make the spinning speed high and to obtain the bicomponent conjugate filaments of fine denier. On the contrary, if the spinning temperature is higher than the mentioned temperature range, a fluidity of the components "A" and "B" is increased, and there is a possibility of frequently occurring filament breaking at the time of melt spinning due to lower melt viscosity. When filament breaking occurs, the broken part is transformed into a polymer drop, and such a polymer drop is mixed into and included in the obtained nonwoven fabric, resulting in a deterioration in quality of the nonwoven fabric. Further, when the fluidity of the components "A" and "B" is increased, the portion near the orifice in the spinneret is easily soiled with decomposed polymers or the like, which requires cleaning of the orifice at a certain interval, eventually resulting in decrease of operational efficiency.

The melt-spinned bicomponent conjugate filaments are then quenched and introduced in an air sucker. The air sucker is also usually called an air jet, which performs spinning and drawing of the filaments by a suction and discharge of air. The bicomponent conjugate filaments introduced in the air sucker is discharged from an exit of the air sucker while being drawn by the air. Then the bicomponent conjugate filament bundles are opened by means of a fiber opening apparatus provided at the exit of the air sucker. A conventionally known method such as corona discharge or frictional electrification can be employed as the opening method. The opened bicomponent conjugate filaments are then accumulated on a moving conveyor of a wire gauge, etc. to be formed into a web.

Heat is applied to predetermined areas of the wed in the thickness direction of the. Then only the component "A" of the bicomponent conjugate filaments in the predetermined areas is softened and molten, whereby the bicomponent conjugate filaments are heat bonded to form the heat bonded areas. The predetermined (heat bonded) areas are provided with a certain space between one area and another, for example, in the form of dots or lattices in the web. In the predetermined areas, the heat is applied thereto in the thickness direction of the web so as to be of almost the same temperature throughout the predetermined areas. If the heat is not applied in the thickness direction but applied only to the surface or back side of the web, there arises a problem that the component "A" of the bicomponent conjugate filaments is not sufficiently softened or molten in the middle of the thickness of the web, and the bicomponent conjugate filaments are not sufficiently heat bonded to one another, and as a result the tensile strength of the obtained nonwoven fabric is not improved. As a desirable heat application method, it is, for example, possible to employ an embossing apparatus comprising an engraved roller and a flat roller or another embossing apparatus comprising a pair of engraved rollers, and to press the web with convex parts of the heated engraved rollers. At this time, it is preferable that the convex parts have been heated to a temperature not higher than the melting point of the component "A". If the convex parts have been heated to be higher than the melting point of the component "A", the component "A" is molten even in the other areas than the areas on the web pressed by the convex parts, in such cases the heat bonded areas becomes larger than the predetermined percentage, resulting in poor softness of the obtained nonwoven fabric. In this connection, any pattern can be employed as the pattern of the top face of the convex part, i.e., the top face of the convex part of the engraved roller can be circular, ellipsoidal, diamond-shaped, triangular, T-shaped, #-shaped or lattice shaped. The heat bonded areas can be formed with the use of an ultra-sonic bonding apparatus. The ultra-sonic bonding apparatus radiates an ultra-sonic wave to the predetermined areas of the web, whereby the component "A" is molten by a frictional heat generated among the bicomponent conjugate filaments in the areas.

The heat bonded areas can be formed in the web at any desired percentage, but in the present invention, it is preferable that the heat bonded areas are formed so as to occupy 5 to 50% of the entire area of the obtained nonwoven fabric. If the heat bonded areas are less than 5% of the entire area of the obtained nonwoven fabric, the tensile strength of the obtained nonwoven fabric tends to be decreased. On the contrary, if the heat bonded areas are more than 50%, the heat bonded areas in which the bicomponent conjugate filaments are heat bonded is increased, and the softeness of the obtained nonwoven fabric tends to be poor.

According to the manner described above, a fleece in which the bicomponent conjugate filaments are heat bonded to one another in the predetermined areas is obtained. The fleece is then subject to wrinkling. As a wrinkling method, for example, there are several applicable methods such as a bending-compression method in which, at the time of introducing the fleece between the rollers, an input speed is made higher than an output speed so as to bend the fleece, and a high pressure liquid current application method in which a high pressure liquid current is applied to the fleece, etc. Any other method can be applied as far as a wrinkling action for splitting the bicomponent conjugate filaments which may be sufficiently applied to the fleece. In case of employing the bending-compression method, it is preferable to use a wrinkling apparatus such as the Microcreper produced by Micrex Co., COMFIT Machine produced by Uenoyama Kiko Co., etc. In case of employing the high pressure liquid application method, it is required to dry the fleece after wrinkling because the fleece absorbs moisture. On the other hand, when employing the bending-compression method, such a drying process is not required, which is an economic advantage of the bending-compression method.

The mentioned splitting treatment by wrinkling has the following advantages as compared with the treatment by the conventionally known needle punching or water jet needling. More specifically, in the treatment by needle punching or water jet needling, it is certain that the bicomponent conjugate filaments are successfully split in the portion where the punching needle or the water jet needle has passed through, but it is difficult to insure that the bicomponent conjugate filaments may be split in the portion where the punching needle or the water jet needle has not passed through, resulting in a low splitting percentage of the bicomponent cojugate filaments. On the other hand, because the wrinkling employed in the present invention is applied evenly to the entire bicomponent conjugate filaments, splitting can be preferably achieved at a high percentage. Further, in the treatment by needle punching or water jet needling, there is a possibility that the punching needle or the water jet needle passes through the already heat bonded areas, resulting in breakdown or damage of the heat bonded areas. On the other hand, in the wrinkling of the present invention, because foreign matters giving a considerable impact are not applied to the fleece at all, it is difficult to break or damage the heat bonded areas. Furthermore, in the treatment by needle punching or water jet needling, because a large kinetic energy is applied to the filaments, there is a possibility that the split filaments are three-dimensionally entangled with one another so closely, resulting in bulkiness reduction. On the other hand, in the wrinkling, because a large amount of kinetic energy is not applied to the filaments, the split filaments are not substantially three-dimensionally entangled, which does not result in the considerable reduction of bulkiness.

As a result of the wrinkling treatment described above, the bicomponent conjugate filaments are successfully split also in the areas other than the heat bonded areas, i.e., non-heat bonded areas, whereby the filaments "A" exclusively composed of the component "A", and the filaments "B" exclusively composed of the components "B" are produced. A splitting extent, i.e., a splitting percentage of the bicomponent conjugate filaments in the non-heat bonded areas is preferably not less than 70%, and more preferably not less than 95%. The splitting percentage is determined depending upon how much length is to be split longitudinally along the full length of the bicomponent conjugate filaments existing in the non-heat bonded area. For example, in bicomponent conjugate filaments of 10 m in length, when 7 m thereof is split and 3 m thereof is not split to be left as non-split bicomponent conjugate filaments, the split percentage is 70%. It is to be noted that, by producing the filaments "A" and "B" both of a finer denier than that of the bicomponent conjugate filaments, the softness of the non-heat bonded areas is improved, and the bulkiness of the non-heat bonded areas is increased thereby improving the heat insulating property. In the meantime, the bicomponent conjugate filaments existing in the heat bonded areas are combined with one another by the heat bonding of the component "A", therefore, are almost unsplit.

Figure 1:
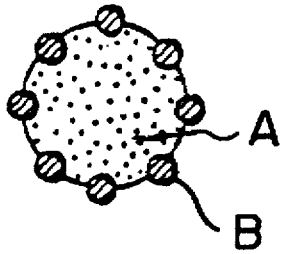
FIG. 1 is a schematic view illustrating one example of a cross-section of the bicomponent conjugate filament employed in the present invention.
Figure 4:
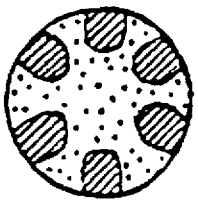
FIG. 4 is a schematic view illustrating a still further example of a cross-section of the bicomponent conjugate filament employed in the present invention.
Figure 6:
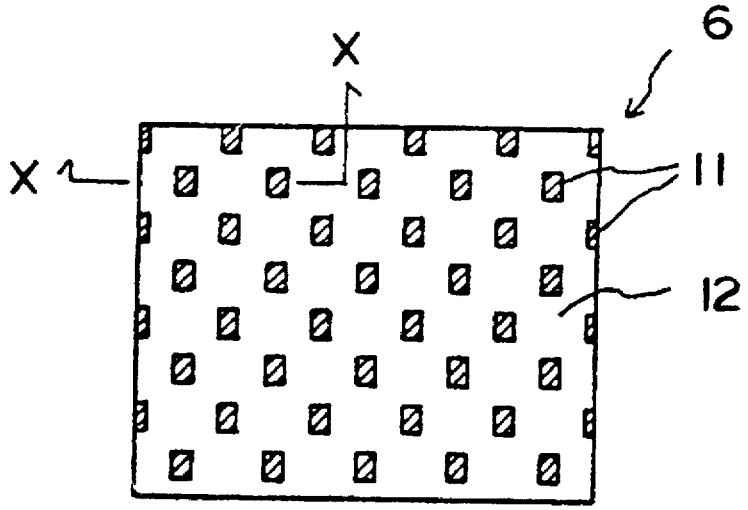
FIG. 6 is a plan view of a nonwoven fabric made of fine denier filaments in accordance with one example of the present invention.
Figure 7:
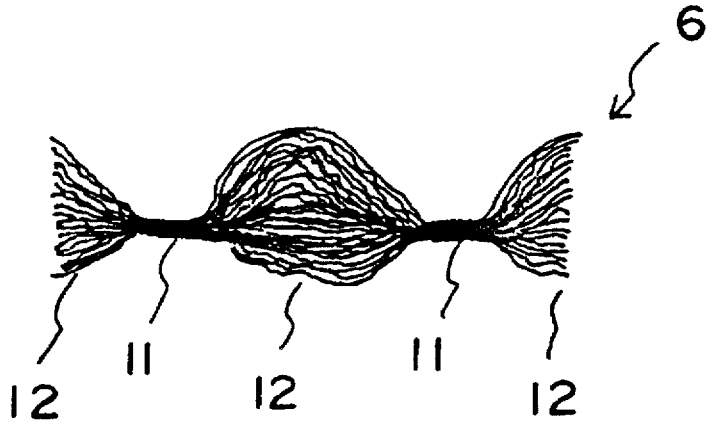
FIG. 7 is a sectional view of the nonwoven fabric made of fine denier filaments taken along the line X—X shown in FIG. 6.

The nonwoven fabric obtained in the mentioned manner is further described more specifically hereinafter with reference to FIG. 6 and FIG. 7. The nonwoven fabric 6 made of fine denier filaments is formed of the heat bonded areas 11 and the non-heat bonded areas 12. In the heat bonded areas 11, the bicomponent conjugate filaments are mutually combined by heat bonding the component "A", and in the non-heat bonded areas 12, the filaments "A" and filaments "B" both produced by splitting the bicomponent conjugate filaments and are accumulated to be bulky without a substantial filament combination and entanglement. The filaments "A" exclusively composed of the component "A" which are produced by splitting the bicomponent conjugate filaments, are preferably in the range of 0.05 to 2.0 denier. On the other hand, the filaments "B" exclusively composed of the component "B" are preferably in the range of 0.02 to 0.8 denier. The filaments "A" and "B" may have the same denier, but usually the filament "A" has a relatively large denier (i.e., 1.5 to 3 times as large as a denier of the filaments "B"). Because it is sometimes the case to use the bicomponent conjugate filaments, in which the component "B" is separated into a large number of parts and arranged on the surface of the bicomponent conjugate filaments, the component "A", is located in the center of the bicomponent conjugate filaments without such a separation, as illustrated in FIG. 1 or FIG. 4.

The length of the bicomponent conjugate filaments employed in the present invention is infinitely long, and accordingly, the bicomponent conjugate filaments extend over the heat bonded areas 11 and non-heat bonded areas 12. In the heat bonded areas 11, the bicomponent conjugate filaments are combined with one another by the heat bonding of the component "A", and these bicomponent conjugate filaments are split in the non-heat bonded areas 12. The nonwoven fabric 6 made of fine denier filaments obtained by the method in accordance with the present invention is composed of a large number of accumulated bicomponent conjugate filaments, and in each of the bicomponent conjugate filaments, the portions existing in the heat bonded areas 11 are mutually combined with one another, while the portions existing in the non-heat bonded areas 12 are split to form the filaments "A" and "B", in the machine direction of the conjugate filaments. As a result, in the nonwoven fabric made of fine denier filaments by the method in accordance with the present invention, the portion of the filaments forming the non-heat bonded areas 12 and those forming the heat bonded areas 11 are continuously linked to each other, thereby a sufficiently high tensile strength is achieved.

The basis weight (per square meter) of the nonwoven fabric made of fine denier filaments obtained by the method in accordance with the present invention can be determined at the discretion of the person skilled in the art, but it is usually in the weight of 10 to 250 g/m$^2$. The nonwoven fabric made of fine denier filaments of the lower weights is preferably fit for various uses including bedclothes such as a bed sheet or a pillow case, absorbents for hygienic goods such as a sanitary napkin or a diaper, or oil absorbents for domestic and industrial uses. On the other hand, the nonwoven fabric made of fine denier filaments of the higher weights is preferably fit for various uses including filter materials, waddings for sleeping bag or other bedclothes, dummy weight fillings, ground fabrics for carpet or artificial leathers, fertilizer abosrbents for gardening or seed beds, heat insulating materials for buildings or walls thereof.

The nonwoven fabric made of fine denier filaments obtained as described above and the production method thereof in according to the present invention have the following technical advantages.

Specified bicomponent conjugate filaments employed in the present invention perform functions both as heat sensitive adhesive filaments and as splitting type filaments. Accordingly, taking advantage of such characteristic functions, in the predetermined areas of the web formed by accumulating the bicomponent conjugate filaments, the function of the heat sensitive adhesiveness is caused to be manifested for heat bonding the bicomponent conjugate filaments to one another, while in the areas other than the heat bonded areas of the web, the splitting function is caused to be manifested for producing the nonwoven fabric made of fine denier filaments from the bicomponent conjugate filaments. Accordingly, since the fine denier filaments are accumulated also in the areas other than the heat bonded areas in which the bicomponent conjugate filaments are mutually heat bonded to one another, i.e., in the non-heat bonded areas, the obtained nonwoven fabric has an unique advantage in the aspects of bulkiness, heat retaining property and softness.

Further, in the method in accordance with the present invention, the wrinkling is employed as a splitting process of the bicomponent conjugate filaments. Accordingly, the splitting percentage of the bicomponent conjugate filaments becomes much higher as compared with that by conventional needle punching or conventional water jet needling. As a result, a technical advantage is achieved such that splitting takes place also in the non-heat bonded areas, whereby the obtained nonwoven fabric is improved in aspects of the bulkiness, heat insulating property and softness. In the present invention, since the bicomponent conjugate filaments are split by wrinkling action, a further technical advantage is achieved such that there is no problem with foreign material having a strong impact force running through the fleece as is often the case in conventional needle punching or conventional water jet needling. As a result, the heat bonded areas are almost free from any breakdown or damage, and the obtained nonwoven fabric is prevented from having a reduced tensile strength. In conventional needle punching or conventional water jet needling, the split filaments are easily three-dimensionally entangled as mentioned above. On the other hand, since wrinkling is employed in this invention, the split filaments are hardly three-dimensionally entangled. As a result, in the present invention, a still further technical advantage is achieved such that the split filaments are prevented from a reduction in bulkiness without three-dimensional entanglement in the non-heat bonded areas.

Furthermore, in the method in accordance with the present invention, since heat is applied to the predetermined areas in the thickness direction, the bicomponent conjugate filaments existing in these areas are almost perfectly heat bonded to one another. It is also to be noted that the filaments existing in both the heat bonded areas and the non-heat bonded areas derive from the same bicomponent conjugate filaments, though their mechanical and thermal conditions are different, and the bicomponent conjugate filaments extend over and run through both heat bonded areas and non-heat bonded areas and, moreover, the non-heat bonded areas are formed of fine denier filaments. Accordingly, in the nonwoven fabric made of fine denier filaments, the bicomponent conjugate filaments are necessarily heat bonded to one another in the heat bonded areas, and these heat bonded areas are connected with one another through fine denier filaments in the non-heat bonded areas. As a result, when a tensile force is applied to such a nonwoven fabric made of fine denier filaments, a yet further advantage is achieved such that both heat bonded areas and non-heat bonded areas are hardly broken, and exhibit high tensile strength.

EXAMPLES

Example 1

A high density polyethylene, the melting point of which is 130° C. and the melt index value (measured in accordance with the method prescribed in ASTM D1238 (E)) is 20 g/10 min, was prepared as a thermoplastic polymer component "A". A polyethyleneterephthalate, of which the melting point is 258° C. and the relative viscosity at 20° C. is 1.38 when dissolved with an equally mixed solvent of tetrachloroethane and phenol, was also prepared as a thermoplastic polymer component "B". Then, a bicomponent melt spinning was performed employing these components "A" and "B". In this bicomponent melt spinning, a melt spinning apparatus equipped with a spinneret having 162 orifices arranged in 4 spinning positions was employed. The bicomponent melt spinning was performed in such a manner that the polymer output of each orifice was 1.20 g/min, the component "A" output of each orifice was 0.60 g/min, and the component "B" output of each orifice was 0.60 g/min. In addition, the spinning temperature was set to 230° C. for the component A and to 285° C. for the component B.

After completing the mentioned bicomponent melt spinning, the bicomponent conjugate filaments were drawn at a speed of 4000 m/min by six suckers per one spinning position each disposed 120 cm below the spinneret. Each of the bicomponent conjugate filaments obtained in this manner having a cross-sectional view as illustrated in FIG. 1 was 2.70 denier in fineness. Subsequently, the drawn bicomponent conjugate filament bundles were subjected to opening by a corona discharge and accumulated on a moving conveyor net, thereby forming a web. The web was introduced between an engraved roller and a flat roller both heated to 120° C. As a result, areas of the web in contact with convex parts of the engraved roller were heated in the thickness direction, whereby the polyethylene of the bicomponent conjugate filaments was softened and the bicomponent conjugate filaments were heat bonded to one another. The heat bonded areas corresponding to the convex parts of the engraved roller were distributed like dots, and the total area thereof occupied 14% of the entire surface area of the nonwoven fabric.

In this manner, a fleece was obtained in which the bicomponent conjugate filaments were mutually connected to one another in the heat bonded areas, while the bicomponent conjugate filaments were simply accumulated in the non-heat bonded areas. Wrinkling was then applied to this fleece by the apparatus illustrated in FIG. 5. This apparatus is the Microceper II produced by Micrex Co., and the conditions of the wrinkling were set to be as follows:

Working speed: 10 m/min.

Nip pressure of feed rollers 1, 2: 6 kg/cm$^2$;

Pressure of upper retarder 3: 3 kg/cm$^2$;

Temperature of feed rollers 1, 2: 50° C.;

Pressure of lower retarder 4: 5 kg/cm$^2$;

Distance between a tangent at the contact point between feed rollers 1, 2 and upper retarder 3: 5 mm; and Distance between a tangent at the contact point between feed rollers 1, 2 and lower retarder 4: 10 mm.

Figure 5:
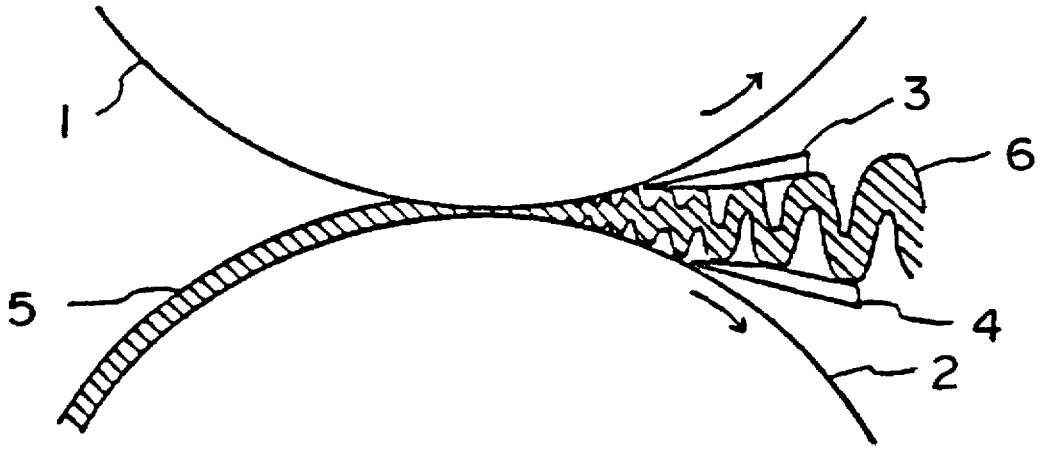
FIG. 5 is an enlarged side view illustrating an example of a wrinkling apparatus employed in the present invention.

In FIG. 5, the reference numeral 5 indicates the fleece and the numeral 6 indicates the obtained nonwoven fabric made of fine denier filaments.

In the nonwoven fabric made of fine denier filaments obtained in the mentioned manner, very fine polyethyleneterephthalate filaments of 0.17 denier and polyethylene filaments of 0.14 denier both produced as a result of splitting the bicomponent conjugate filaments by wrinkling were mixedly accumulated in the non-heat bonded areas. And in the heat bonded areas, the bicomponent conjugate filaments were mutually connected to one another as a result of heat bonding of the polyethylene included in the bicomponent conjugate filaments. In this process, the splitting percentage of the bicomponent conjugate filaments in the non-heat bonded areas was 95%. And the weight per square meter of the obtained nonwoven fabric made of fine denier filaments, (basis weight) was 50 g/m$^2$.

Example 2

A nylon 6, of which the melting point is 130° C. and the relative viscosity measured with 96% concentration solution of sulfuric acid at 25° C. is 2.57, was prepared as a thermoplastic polymer component A. Further, a polyethyleneterephthalate, the same as the one employed in Example 1, was prepared as a thermoplastic polymer component B. Then, a bicomponent melt spinning was performed employing these components A and B. In this step, the bicomponent melt spinning was performed in the same manner as the foregoing Example 1, except that orifices by which 16 radial segments and a center hollow segment were formed were employed as spinning orifices so as to obtain the bicomponent conjugate filaments having the sectional view illustrated in FIG. 2, and a spinning temperature of the component A set to 270° C.

Then, the bicomponent conjugate filaments were drawn by air suckers in the same manner as the foregoing Example 1, whereby the bicomponent conjugate filaments having a cross-section as illustrated in FIG. 2 were obtained, the denier of which was 2.7. Subsequently, a web was formed in the same manner as the foregoing Example 1, and a fleece was obtained in the same manner as the foregoing Example 1 except that the temperatures of the engraved roller and flat roller were set to 210° C. Wrinkling was then applied to this fleece in the same manner as the foregoing Example 1, and thus a nonwoven fabric made of fine denier filaments was obtained.

In the nonwoven fabric made of fine denier filaments obtained in the mentioned manner, very fine nylon filaments 6 of 0.17 denier and polyethylene filaments both produced as a result of splitting the bicomponent conjugate filaments by wrinkling were mixedly accumulated in the non-heat bonded areas. And in the heat bonded areas, the bicomponent conjugate filaments were mutually connected to one another as a result of heat bonding of the nylon 6 included in the bicomponent conjugate filaments. In this process, the splitting percentage of the bicomponent conjugate filaments in the non-heat bonded areas was 82%. And the weight per square meter of the obtained nonwoven fabric made of fine denier filaments was 50 g/m$^2$.

Example 3

Wrinkling was applied to the fleece obtained in the foregoing Example 2 by means of a "Loco" type jet dyeing machine (produced by Hokuriku Kakoki). Simultaneously with such wrinkling, dyeing was applied to the componenet of nylon 6 included in the fleece and to the fine filaments of nylon 6 produced by the wrinkling. As for the dyeing conditions, an aqueous solution of 2000 liters containing Blue FFB (produced by Sumitomo Chemical Company Ltd.), 0.2% o.w.f. used as an acid dye, Migregal WA-10 (produced by Senka Co.,), 0.5 g/l used as a leveling agent, and an acetic acid disssolved so as to be pH 5 was employed. Conditions of applying a liquid current to the fleece were established as follows:

Liquid temperature: 100° C.;

Conveying speed of the fleece: 100 m/min;

Nozzle pressure: 3 kg/cm$^2$; and

Application time: 1 hour.

After performing the wrinkling and the dyeing by the "Loco" type jet dyeing machine, dehydration and drying were performed, whereby a nonwoven fabric made of fine denier filaments was obtained.

In the nonwoven fabric made of fine denier filaments obtained in the mentioned manner, very fine nylon filaments 6 of 0.17 denier and polyethylene filaments both produced as a result of splitting the bicomponent conjugate filaments by wrinkling were mixedly accumulated in the non-heat bonded areas. And in the heat bonded areas, the bicomponent conjugate filaments were mutually connected to one another as a result of heat bonding of the nylon 6 included in the bicomponent conjugate filaments. In this process, the splitting percentage of the bicomponent conjugate filaments in the non-heat bonded areas was 88%. And the weight per square meter of the obtained nonwoven fabric made of fine denier filaments was 50 g/m$^2$.

Example 4

A polyethyleneterephthalate and a polyethylene both the same as the ones employed in the foregoing Example 1 were prepared. Orifices, having 48 radial segments (24 segments each) and a center hollow segment, were employed as spinning orifices so as to obtain the bicomponent conjugate filaments having a cross-section as shown in FIG. 2. In this step, the output ratio of polyethyleneterephthalate/polyethylene from the orifices was set to be 1.5/l. Then, bicomponent melt spinning was performed in the same manner as the foregoing Example 1 except that the spinning temperature of the component A was set to 270° C.

The bicomponent conjugate filaments were then drawn by air suckers in the same manner as the foregoing Example 1, whereby the bicomponent conjugate filaments having a cross-section as illustrated in FIG. 2, the denier of which was 2.0 were obtained. Subsequently, a web was formed in the same manner as the foregoing Example 1, and a fleece was obtained in the same manner as the foregoing Example 1 except that the belt conveyor speed was changed. Wrinkling was then applied to this fleece in the same manner as the foregoing Example 1, and a nonwoven fabric made of fine denier filaments was obtained.

In the nonwoven fabric made of fine denier filaments obtained in the mentioned manner, very fine polyethylene filaments of 0.03 denier and polyethyleneterephthalate filaments of 0.05 denier both produced as a result of splitting the bicomponent conjugate filaments by wrinkling were mixedly accumulated in the non-heat bonded areas. And in the heat bonded areas, the bicomponent conjugate filaments were mutually connected to one another as a result of heat bonding of the polyethylene included in the bicomponent conjugate filaments. In this process, the splitting percentage of the bicomponent conjugate filaments in the non-heat bonded areas was 73%. And the weight per square meter of the obtained nonwoven fabric made of fine denier filaments was 25 g/m$^2$.

Characterization of The Nonwoven Fabric Made of Fine Denier Filaments Obtained in Examples 1 to 4

With respect to the nonwoven fabric made of fine denier filaments and obtained by the methods in accordance with the foregoing Examples 1 to 4, the following characteristic values were measured. Table 1 shows the result.

(1) Tensile strength (kg/5 cm): 10 test pieces of a nonwoven fabric of 10 cm in length and 5 cm in width were prepared in accordance with the strip method prescribed in JIS L-1096. Each test piece was stretched in machine direction (MD) and cross direction (CD) at a tensile speed of 10 cm/min by means of a Tensilon UTM-4-1-100 (produced by Toyo Baldwin), and an average value of the obtained maximum loads was converted to a value of 100 g/m$^2$, and (the thus converted value) was established as a tensile strength.

(2) Elongation (%): The measurement of elongation was carried out simultaneously with the foregoing tensile strength in the machine direction (MD) of each test piece of the nonwoven fabric, then elongations at the maximum strength were recorded, and an average value of these elongations was established as the elongation.

(3) Tearing strength (kg): 3 test pieces of a nonwoven fabric of 6.5 cm in length and 10 cm in width were prepared in accordance with the pendulum method prescribed in JIS L-1096. A line of 2 cm in length was cut perpendicularly to the longitudinal direction at almost the center of the length and in the middle part between two clamps of the test piece by means of a sharp cutter. Thus, maximum loads at the time of breaking the remaining 4.5 cm of each test piece were separately measured, and an average value of the obtained maximum loads were established as a tearing strength.

(4) Softness (g): 5 test pieces of a nonwoven fabric of 10 cm in length and 5 cm in width were prepared. Each test piece was laterally curved to form a hollow cylinder, and both end edges of the cylinder are joined to form a cylindrical test sample. Each test sample in a cylindrical shape was compressed in its axial direction thereof at a compression speed of 5 cm/min by means of a Tensilon UTM-4-1-100 (produced by Toyo Baldwin), and an average value of the obtained maximum loads were established as a softness. This softness means that the nonwoven fabric has more softness as the value is smaller.

(5) Air permeability (cc/cm$^2$/sec): 3 test pieces of a nonwoven fabric of 15 cm in length and 15 cm in width were prepared in accordance with the Frazir method prescribed in JIS L-1096. A Frazir type tester was employed in the measurement. After mounting each test piece on one end of a cylinder of this tester, a suction fan was adjusted by a rheostat to suck the air in such a manner that a tilting type pressure gauge (manometer) may indicate a 1.27 water column, and the amount of the air passing through the test sample was obtained from a barometric height read on a barometer and a type of an air hole with reference to a table annexed to the tester, whereby an average value of the amounts of air was established as an air permeability.

(6) Bulk density (g/cm$^3$): A measuring apparatus of a presser foot of 50 mm in diameter was employed to measure a thickness in accordance with JIS L-1096. The thickness was measured at 5 points located equally spaced across 1 m of the nonwoven fabric width under a load of 4 g/cm$^2$ for 10 sec. An average value of the obtained thicknesses was established as the thickness, and a bulk density was calculated by the following expression:

$$\text{Bulk density } (g/cm^2) = \text{basis weight } (g/m^2)/(\text{thickness } (mm) \times 1000)$$

It is to be noted that as the smaller the value of the bulk density, the more superior the bulkiness.

TABLE 1

| | Example | | | |
|---|---|---|---|---|
| | 1 | 2 | 3 | 4 |
| Tensile strength (kg/5 cm) MD/CD | 23.1/12.5 | 25.6/15.0 | 22.4/13.2 | 8.8/11.8 |
| Elongation % | 51 | 48 | 52 | 40 |
| Tearing strength kg | 1.61 | 1.75 | 1.58 | 1.05 |
| Softness g | 23 | 30 | 35 | 6 |
| Air permeability cc/cm$^2$ sec | 90 | 64 | 52 | 63 |
| Bulk density g/cm$^3$ | 0.130 | 0.124 | 0.127 | 0.115 |

What is claimed is:

1. A nonwoven fabric made of fine denier filaments from bicomponent conjugate filaments which are bicomposed of a thermoplastic polymer component "A", and a thermoplastic polymer component "B" insoluble in said component "A" and having a melting point higher than that of said component "A" by 30° to 180° C., and in which at least said component "A" is exposed on a surface of the bicomponent conjugate filaments, and in each of which said component "B" occupy more than one sphere, said nonwoven fabric being characterized by; heat bonded areas where said bicomponent conjugate filaments are heat bonded to one another, said heat bonded areas being spaced apart between one heat bonded area and another by softening or melting only said component "A" of said bicomponent conjugate filaments; non bonded areas without heat bonded bicomponent conjugate filaments which have filaments "A" exclusively composed of the component "A" manifested as split bicomponent conjugate filaments, filaments "B" exclusively composed of the component "B" manifested as split bicomponent conjugate filaments, and bicomponent conjugate filaments which are not split, and said filaments "A" said filaments "B" and said nonsplit bicomponent conjugate filaments being included without substantial three-dimensional entanglements thereamong.

2. A nonwoven fabric made of fine denier filaments in accordance with claim 1, wherein the fineness of said filaments A is 0.05 to 2.0 denier, and that of said filaments B is 0.02 to 0.8 denier.

3. A method for producing a nonwoven fabric made of fine denier filaments, comprising the steps of:

forming a web by accumulating bicomponent conjugate filaments, each of which is bicomposed of a thermoplastic polymer component "A" and a thermoplastic polymer component "B" insoluble in said component "A" and having a melting point higher than that of said component "A" by 30° to 180° C., in each of which at least said component "A" is exposed on a surface of the bicomponent conjugate filament, and in each of which said component "B" occupy more than one sphere;

applying heat to predetermined spaced apart areas on the web in the direction of web thickness, thereby softening or melting only said component "A" and obtaining a fleece containing non-heated bonded areas, and in which the heat bonded areas are formed by heat bonding said bicomponent conjugate filaments at spaced intervals; and wrinkling said fleece to split said bicomponent conjugate filaments existing in the non-heat bonded areas, thereby having filaments "A" exclusively composed of said component "A" and filaments "B" exclusively composed of said component "B".

4. A method for producing a nonwoven fabric made of fine denier filaments in accordance with claim 3, wherein the degree of splitting of said bicomponent conjugate filaments in the non-heat bonded areas is not less than 70%.

* * * * *